United States Patent [19]

Moriya

[11] 4,172,360

[45] Oct. 30, 1979

[54] DIGITAL ALARM TIMEPIECE

[75] Inventor: Tokio Moriya, Tokyo, Japan

[73] Assignee: Kabushiki Kaisha Daini Seikosha, Japan

[21] Appl. No.: 731,656

[22] Filed: Oct. 12, 1976

[30] Foreign Application Priority Data

Oct. 14, 1975 [JP] Japan ..... 50-123397

[51] Int. Cl.[2] ..... G04C 21/00; G04F 8/00; G04B 23/12

[52] U.S. Cl. ..... 58/38 R; 58/39.5; 58/50 R; 58/57.5; 58/85.5

[58] Field of Search ..... 58/4 A, 23 R, 38, 39.5, 58/50 R, 57.5, 152 B; 235/92 J

[56] References Cited

U.S. PATENT DOCUMENTS

| | | | |
|---|---|---|---|
| 3,745,761 | 7/1973 | Tsuruishi | 58/38 |
| 3,795,099 | 3/1974 | Tsuruishi | 58/23 R |
| 3,813,533 | 5/1974 | Cone et al. | 235/156 |
| 3,822,547 | 7/1974 | Fujita | 58/153 B |
| 3,834,153 | 9/1974 | Yoda et al. | 58/38 |
| 3,854,277 | 12/1974 | Samejima et al. | 58/39.5 T |
| 3,940,919 | 3/1976 | Yasuda et al. | 58/38 R |
| 3,980,868 | 9/1976 | Thompson | 232/92 J |

*Primary Examiner*—Vit W. Miska

*Attorney, Agent, or Firm*—Robert E. Burns; Emmanuel J. Lobato; Bruce L. Adams

[57] ABSTRACT

A digital alarm timepiece including a signal generator for generating a repetitive time standard signal having a rate defining a unit of time, and a time counting circuit for counting the time standard signal to develop a count representative of seconds, minutes and hours. The timepiece further includes a date counting circuit for developing a count representative of date. A timer counting circuit stores a count corresponding to minutes and hours remaining before an alarm time and is connected to the time counting circuit for counting down the count corresponding to minutes and hours before the alarm time in response to advancing of the count stored in the time counting circuit. A display cooperates with the counters to display date, hours, minutes and seconds according to the respective counts stored in the counters. An alarm responds to the count developed by the time counter circuit for developing an alarm signal when the count developed by the time counter circuit is counted down to zero. A selecting circuit selectively applies the count of the time counting circuit and the timer counting circuit to the display for respectively displaying present time and time remaining to the alarm in order to operate the timepiece in either a normal timekeeping mode or a timer mode.

3 Claims, 1 Drawing Figure

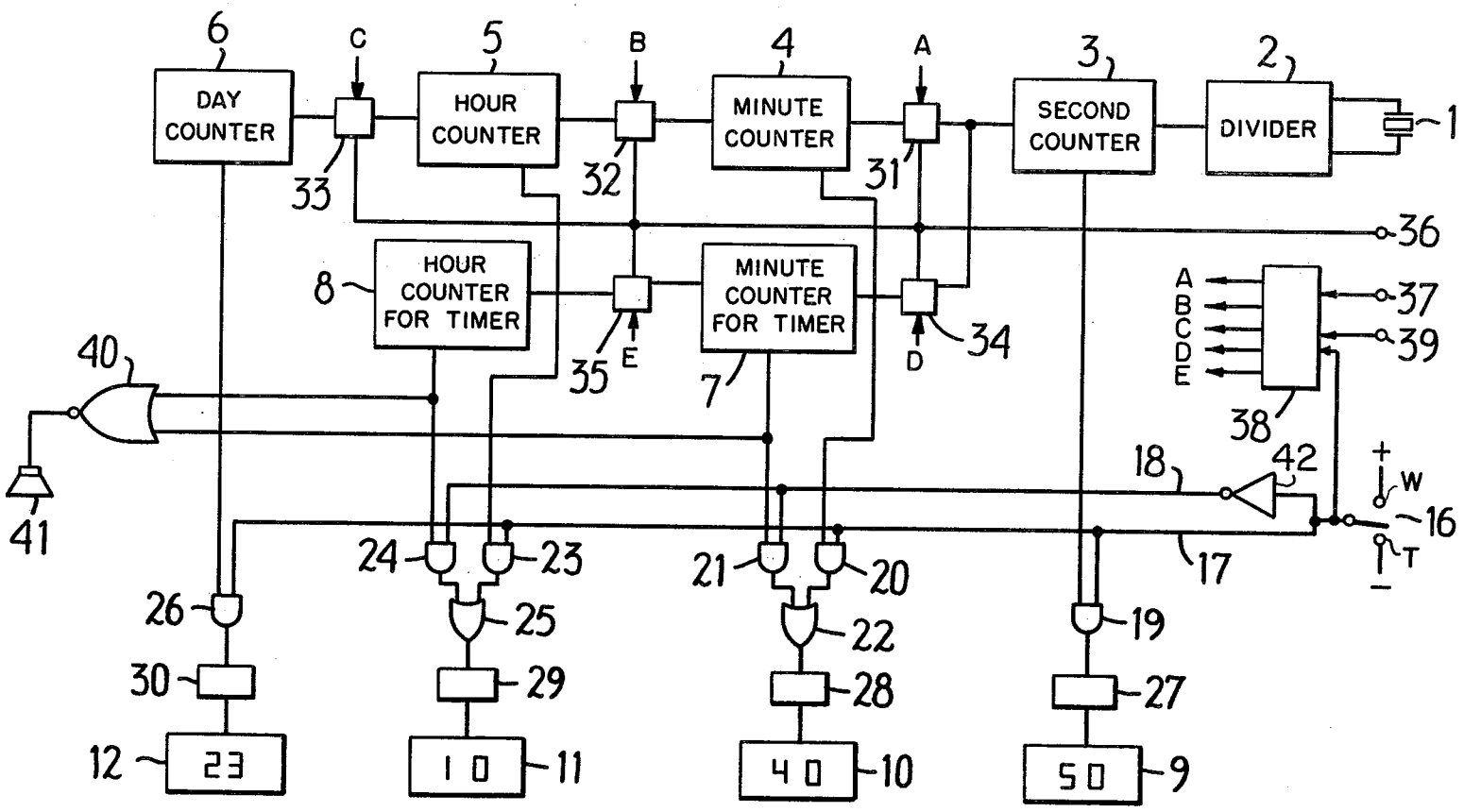
DIVIDER
SECOND COUNTER
MINUTE COUNTER
MINUTE COUNTER FOR TIMER
HOUR COUNTER
HOUR COUNTER FOR TIMER
DAY COUNTER
A
B
C
D
E
W
T
+
−
50
40
10
23

DIGITAL ALARM TIMEPIECE

BACKGROUND OF THE INVENTION

The present invention relates to a digital alarm timepiece and, more particularly to a digital alarm timepiece wherein a standard time and a time remaining before an alarm signal are selectively displayed by operation of a switch, and wherein the alarm is operable even when the standard time is displayed after the remaining time to the alarm is set.

In the conventional digital alarm timepiece, the timepiece actuates an alarm at a set time and it is impossible to know the time remaining to the alarm time.

SUMMARY OF THE INVENTION

The object of the present invention is to provide the effective means to eliminate the above-mentioned disadvantages.

BRIEF DESCRIPTION OF THE DRAWING

An alarm timepiece according to the present invention has the circuit structure illustrated in the sole FIGURE.

DESCRIPTION OF THE PRFERRED EMBODIMENT

Referring now to the preferred embodiment of the digital alarm timepiece according to the present invention illustrated in the drawing; wherein numeral 1 is a quartz vibrator which functions as a time standard, 2 is a divider for dividing a signal from the quartz vibrator 1 down to a second signal, 3 is a second counter to drive a second-figure display 9, 4 is a minute counter which receives a minute signal produced from the final stage of the second counter 3 to drive a minute-figure display 10, 5 is an hour counter which receives an hour signal produced from the final stage of the minute counter 4 to drive an hour-figure display 11, and 6 is a day counter which receives a 24 hours signal produced from the final stage of the hour counter 5 to drive a day-figure display 12. A substraction counter 7 develops a signal to display a minute-figure of a timer, 8 is a substraction counter which develops a signal to display an hour-figure of the timer, and 16 is a switch to switch between a standard watch display mode and a timer display mode. When the switch 16 is connected with the watch display terminal [W], a switch signal becomes high, i.e. (+) and the level of circuit line 17 becomes (+). Consequently, a second display AND gate 19 and a day display AND gate 26 are enabled and apply to the second display 9 and the day display 12 respective signals from the second counter 3 and the day counter 6 via decoders 27 and 30. Moreover, since the level of circuit line 18 is low level, i.e. (−), a minute counter AND gate 20 transmits a signal from the minute counter 4 via an OR gate 22 and a second display decoder 28 for displaying minutes. However, since the level of line 18 remains low (−), a minute counter AND gate 21 for a timer stops a signal from the counter 7. Furthermore, as for the hour display, the hour is displayed by the signal from the hour counter 5.

On the other hand, when the change-over switch 16 is connected with the timer display terminal [T], the level of the circuit line 17 becomes (−) and the level of the circuit line 18 becomes (+) via an inverter 42. And then days and seconds are not displayed since the second display AND gate 19 and the day display AND gate 26 do not send a signal from the second counter 3 to the second display 9, and do not send a signal from the day display counter 6 to the day display 12. The minute counter AND gate 20 is disabled since the level of the circuit line 17 remains (−) and the AND gate 21 of the timer counter 7 enabled since the level of the circuit line 18 remains (+) and the minute display 10 displays a signal from the timer minute counter 7. Similarly the hour counter AND gate 23 is disabled and the timer hour counter AND gate 24 is enabled and the hour display 11 displays a signal from the timer hour counter 8.

Numeral 37 is a terminal for receiving a selecting signal from a selecting switch to appoint a corrected figure when a time is corrected. When the change-over switch 16 is connected with W, i.e. the (+) side, a selecting circuit 38 controls the switching functions of each of the figures by means of transmission gates 33, 32, 31 so that time can be corrected in the order of day→hour→minute. On the other hand, when the change-over switch 16 is connected with T i.e. the (−) side, the selecting circuit 38 controls the switching functions of each of the figures by means of transmission gates 35, 34 so that the timer can be corrected in the order of hour→minute and then the selected figure can be corrected by a setting switch signal applied to terminal 36.

When the change-over switch 16 is connected with T and the timer time is displayed, the day and the second displays disappear and the hour and minute display remain. Next, the selecting signal applied to terminal 37 appoints the hour figure of the timer and the desired time is set by the setting switch signal applied to terminal 36, and then the selecting switch signal applied to terminal 37 appoints the second figure of the timer and the desired time is set by the setting switch signal applied to terminal 36.

When a starting switch signal is applied to terminal 39 after the hour and second figures are appointed, the appointment by the selecting switch signal applied to terminal 37 is terminated and then the contents of the timer minute counter 7 and the timer hour counter 8 which is connected in cascade with timer minute counter 7, are subtracted by a minute signal from the output of the second counter 3. The timer minute counter 7 develops hour output signals occurring once per hour in response to the output of the seconds counter 3, and the hour signals are applied through transmission gate 35 to the timer hour counter 8. When the timer hour counter 8 and the timer minute counter 7 display 0:00, the output from a NOR gate 40 which receives both of the outputs becomes a high (+) voltage and a buzzer 41 buzzes to inform that the setting time has been reached.

By the above structure, the hour display 11 and the minute display 10 display the time remaining before the setting time and the buzzer 41 informs that the setting time has been reached, when the change-over switch 16 is connected with the timer display terminal T.

Even if the change-over switch 16 is connected with terminal W after the timer is set, the buzzer 41 informs that the setting time has been reached since both of the timer hour counter 8 and the timer minute counter 7 are counted down as the time progresses.

By the above structure, it is possible to easily know both of the present time and the time remaining before an alarm time by switching of the change-over switch.

Moreover, it is possible to know a setting time even if it is used as the watch by displaying the watch display after the timer is set.

I claim:

1. A digital alarm timepiece comprising, in combination: time standard signal generating means for generating a repetitive time standard signal having a rate defining a unit of time; a time counting circuit connected to receive said time standard signal for counting the same and for developing a count representative of seconds, minutes and hours; a date counting circuit connected to said time counting circuit and responding to the count developed by said time counting circuit for developing a count representative of date; a timer counting circuit for storing therein a count corresponding to minutes and hours remaining before an alarm time and connected to said time counting circuit for counting down the count corresponding to minutes and hours before the alarm time in response to advancing of the count stored in said time counting circuit with the passage of time; timer setting means for setting the count stored in said timer counting circuit to a desired count corresponding to an arbitrary interval before alarm time, wherein said timer setting means is comprised of a timer minute counter for storing a count representative of a number of minutes until alarm time and for counting down the stored count in response to minute signals applied thereto, a first gate circuit receptive of minute signals occurring once per minute developed by said time counting circuit and receptive of a counter setting signal for setting the timer minute counter for applying either the minute signal or the counter setting signal to said timer minute counter under control of a selecting signal applied to said first gate circuit, a timer hour counter for storing a count representative of a number of hours until alarm time and for counting down the stored count in response to hour signals applied thereto, and a second gate circuit receptive of hour signals occurring once per hour developed by said timer minute counter and receptive of a counter setting signal for setting the timer hour counter for applying either the hour signal or the counter setting signal to said timer hour counter under control of a selecting signal applied to said second gate circuit; display means for cooperating with said counters to display date, hours, minutes and seconds according to the respective counts stored in said counters; alarm means responsive to the count developed by said timer counting circuit for developing an alarm signal when the count developed by said timer counting circuit is counted down to zero; and selecting means for selectively applying the count of said time counting circuit and said timer counting circuit to said display means for respectively displaying present time and time remaining to alarm in order to operate the timepiece in either a normal timekeeping mode or a timer mode.

2. A digital alarm timepiece according to claim 1, wherein said selecting means includes a third gate circuit for selectively applying a count representative of minutes from said time counting circuit or said timer counting circuit to said display means, a fourth gate circuit for selectively applying a count representative of hours from said time counting circuit or said timer counting circuit to said display means, and means for operating said third and fourth gate circuits.

3. A digital alarm timepiece according to claim 2, wherein each of said third and fourth gate circuits is comprised of a two-input OR gate connected for applying an output signal to said display means and a pair of two-input AND gates each connected to apply an output signal thereof to a respective input of said OR gate and each having one input connected to a respective one of said time and said timer counting circuits, and wherein said means for operating applies complementary signals to the respective remaining inputs of said pair of AND gates for selectively enabling one or the other of said AND gates to selectively connect said time or said timer counting circuits to said display means through said third and fourth gate circuits.

* * * * *